United States Patent [19]

Donovan

[11] Patent Number: 4,867,359

[45] Date of Patent: Sep. 19, 1989

[54] FOLDING CARRIER FOR SKI BOOTS

[76] Inventor: Sharon J. Donovan, 12034 S.E. Pardee, Portland, Oreg. 97266

[21] Appl. No.: 670,329

[22] Filed: Nov. 9, 1984

[51] Int. Cl.[4] ..... A45F 3/14

[52] U.S. Cl. ..... 224/202; 224/250; 224/257; 224/917; 224/264; 294/150

[58] Field of Search ..... 224/264, 257, 202, 917, 224/250; 294/137, 143, 145, 146, 147, 149, 150

[56] References Cited

U.S. PATENT DOCUMENTS

| | | | |
|---|---|---|---|
| 2,676,737 | 4/1954 | Zirbel | 224/264 |
| 4,127,223 | 11/1978 | Uchin | 294/150 |
| 4,790,462 | 12/1988 | Kawaguchi | 224/917 |

*Primary Examiner*—Henry J. Recla

*Attorney, Agent, or Firm*—Chernoff, Vilhauer, McClung & Stenzel

[57] ABSTRACT

A carrier for ski boots includes a shoulder strap supporting an adjustable stirrup strap at each end. An adjustable ankle strap is fastened to each stirrup strap to hold a pair of ski boots securely to be carried with one ski boot in front and one ski boot on the back of the user. Each ankle strap includes an adjustable and easily releasable fastener to permit convenient use of the boot carrier for boots of a wide variety of sizes. A cover is fixedly fastened to the shoulder strap, providing padding for the shoulder strap during use of the carrier. The stirrup straps and ankle straps can be folded neatly, and the cover can be fastened around them when they are folded to contain the carrier as a compact package when it is not in use.

16 Claims, 1 Drawing Sheet

FIG. 1
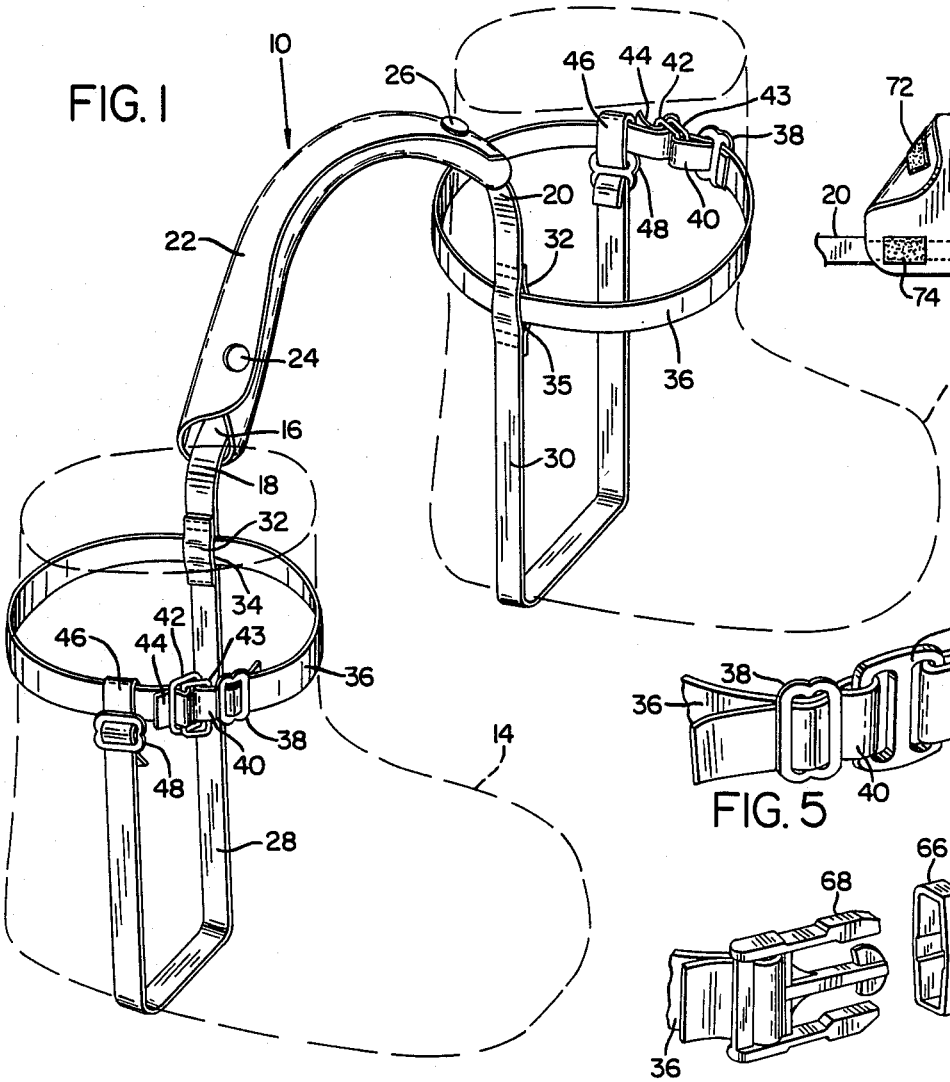
FIG. 7
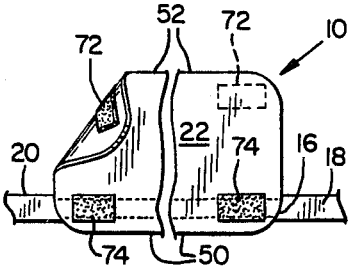
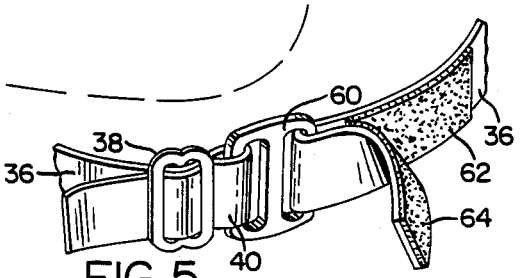
FIG. 5
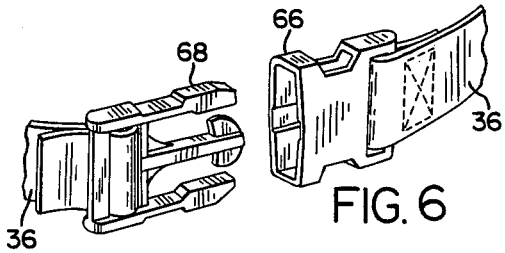
FIG. 6
FIG. 3
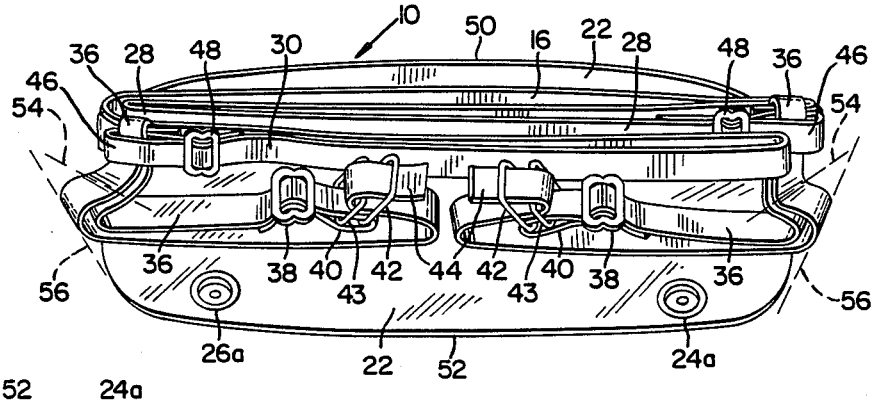
FIG. 2
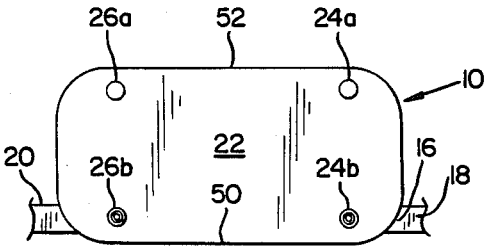
FIG. 4
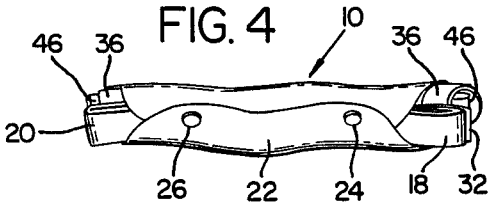

FOLDING CARRIER FOR SKI BOOTS

BACKGROUND OF THE INVENTION

The present invention relates to downhill skiing and specifically to a device for conveniently carrying ski boots of the type used in downhill, or alpine, skiing.

Modern ski boots for use in downhill, or alpine, skiing are large and stiff and extend a considerable distance up the legs of the user, making it somewhat uncomfortable to walk while wearing such boots, although they are adapted particularly well for use in controlling skis. Such boots are normally carried, then, instead of being worn, except while the user is actually on the ski slopes.

Until the late 1960's most ski boots were fastened with laces, which could be tied together to sling a pair of ski boots over one's shoulder with one boot in front and one boot over the back of the skier, but modern ski boots are equipped with buckles instead of laces, making this impossible. Carriers called boot trees are available, to which ski boots may be attached by clamps, allowing a pair of ski boots to be carried in one hand by using such a carrier.

In addition to requiring one to hold a handle, however, many of such previously available "boot tree" carriers are fairly large, including, as they do, a rigid plate to which the ski boots are clamped. Such carriers often take up an undesirable amount of space if stored in a locker at a ski area, but they cannot be carried easily during skiing, and are easily stolen in locations where lockers are not available.

Another carrier consists of a loop of cord, a slide to reduce the size of the opening of the loop, and a T handle to which the loop is fastened. This carrier also keeps the user's hand occupied, and it is not well adapted for carrying some types of boots.

Olson U.S. Pat. No. 3,259,284 discloses a device including a pair of plates to which ski boots are clamped individually. The plates are suspended from a pair of skis carried over one's shoulder, with one boot in front and one behind the user's shoulder. While the Olson device frees the user's hands, it nevertheless occupies an undesirably large amount of space and is not well adapted to being carried by the user during skiing.

While it would be possible to tie a cord to each of a pair of boots and thus carry the boots slung over one's shoulder, there are some drawbacks to doing so. First, it is not particularly easy to tie a cord securely to a ski boot, in a way in which the boots are held conveniently. This is particularly true in cold weather when the skier may be wearing heavy gloves. Additionally, such a cord carried on the shoulder of the user would be uncomfortable, cutting into a skier's shoulder under the weight of a pair of boots.

While it is possible to tie a cord securely to nearly any ski boot, it is very difficult to securely fasten a cord to many types of non-conventional boots in a way n which the boots are suspended in an attitude in which they are easily carried. For example, simply using a noose to fasten a cord to a buckle of some ski boots is possible, but the location of the buckles makes this very awkward with other boots.

It is well known to carry a pair of skis using a strap device, as is shown in Hogensen, Jr. U.S. Pat. Nos. 3,920,166, Helmert U.S. Pat. No. 2,530,695, and Newman U.S. Pat. No. 4,261,493, but no such device for carrying modern ski boots conveniently is known.

What is needed, therefore, is a ski boot carrier which is light in weight, comfortable, and convenient to use, which permits one the free use of his or her hands, which is adaptable for boots having any of the many closure systems, in various sizes, which may be carried easily during skiing, and which occupies only a small amount of space when not in use. Ideally such a boot carrier should carry boots in a position comfortably close to the user's body, so that they do not interfere with normal movement.

SUMMARY OF THE INVENTION

The present invention provides a ski boot carrier which overcomes the shortcomings of previously available ski boot carriers and fills the need for a device which can be conveniently carried while not in use and yet easily attached to a pair of ski boots having any of several different closure locations and types of fasteners to carry the ski boots conveniently without use of the hands.

The ski boot carrier of the present invention includes a shoulder strap to which are attached a pair of stirrups, which may be extensions of the shoulder strap material, and a pair of ankle straps. One ankle strap is attached to each stirrup strap, both at the outer end of the stirrup strap and adjacent the respective end of the shoulder strap. The ankle straps thus hold the stirrup straps in a U-shaped configuration extending beneath the soles of boots being carried, regardless of whether the boots are of the lace closure, conventional buckle closure, non-conventional front buckle closure, rear entry, or of yet other design.

Each of the ankle straps is adjustable, by the use of a pair of D-rings or the like fastened to one end of the strap, to grip the other end of the ankle strap at a desired position. Hook-and-loop fastening material on the strap, or side-release buckles adjustably positioned on the ends of the ankle strap may be used instead, if preferred.

Each of the ankle straps is fastened to one of the stirrup straps near the respective end of the shoulder strap, and the outer end of the stirrup strap is adjustably looped over the ankle strap at another location which will be on the opposite side of a ski boot. The loop in the stirrup strap is adjustable, as by the use of a triple bar slide or other adjustable fastener, to permit the stirrups to be adjusted to the desired length to conveniently and comfortably support the ski boots with which the carrier is being used.

A cover is fastened to the shoulder strap and extends along its length. The cover is a piece of soft flat material, such as soft leather or a padded fabric, and may be fastened wrapped around the shoulder strap as a pad when the ski boot carrier is being used. This makes the strap comfortable on the user's shoulder, especially during spring and summer skiing when a user might not wear clothing heavy enough to provide padding.

The stirrups and ankle straps of the boot carrier may be folded to lie neatly alongside the shoulder strap. The cover is of such a size that it can be wrapped tightly around the folded stirrups and ankle straps and be fastened in the form of a package having the length of the shoulder strap portion of the ski boot carrier and being approximately 1½ inches in diameter.

The cover can be fastened to the shoulder strap, for example, by using the male halves of a pair of snap fasteners as rivets. The snap fasteners can then be used to hold the cover wrapped around the shoulder strap, either during use of the boot carrier or when the stirrups and ankle straps are folded within the cover.

When the boot carrier is in its folded configuration it forms a soft, compact, sausage-shaped package which can be carried conveniently in a large pocket or waist pack, or can be stored in a locker, where it will occupy only a small amount of the available space.

It is therefore a principal object of the present invention to provide an improved and convenient ski boot carrier which is small and light in weight.

It is another important object of the present invention to provide an improved ski boot carrier which is comfortable to use and enables one to carry a pair of ski boots without one's hands being encumbered.

It is an important feature of the present invention that it provides a ski boot carrier including stirrup and ankle straps to hold boots, a shoulder strap connecting the stirrup straps to one another, and a cover which may be fastened around the straps, forming a neat, compact package when the carrier is not in use.

It is another important feature of the present invention that it includes straps which are adjustable in length to fit a wide variety of different sizes and styles of both conventional and non-conventional ski boots.

It is yet a further feature of the present invention that its cover acts as a pad for the shoulder strap during use of the ski boot carrier.

It is a principal advantage of the present invention that it provides a ski boot carrier which is adaptable for conveniently carrying more different types of ski boots than previously known carriers for such boots.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a view of a ski boot carrier embodying the present invention attached to a pair of ski boots.

FIG. 2 is a view of the shoulder strap and cover of the ski boot carrier shown in FIG. 1, with the cover open.

FIG. 3 is a view of the ski boot carrier shown in FIG. 1, showing the manner of folding and closing it.

FIG. 4 is a view of the ski boot carrier shown in FIG. 1, in its folded configuration.

FIG. 5 is a view of a detail of the ski boot carrier shown in FIG. 1, showing an alternative fastener for the ankle strap thereof.

FIG. 6 is a view similar to FIG. 5, showing yet another alternative fastener for closing the ankle strap thereof.

FIG. 7 is a view similar to FIG. 2, showing an alternative type of fastener for holding the cover closed.

DETAILED DESCRIPTION OF THE INVENTION

Referring now to the drawings, in FIG. 1 a boot carrier 10 embodying the present invention is shown attached to a pair of ski boots 12 and 14 shown in phantom line. The boot carrier 10 includes a shoulder strap portion 16 having a pair of opposite ends 18 and 20. The shoulder strap 16 may be of any suitably strong material, for example, a woven nylon strap about 1 inch wide and about 11 inches long.

A cover 22 is wrapped around the shoulder strap 16 forming a tubular sleeve surrounding the shoulder strap and providing padding for it. A pair of snap fasteners 24 and 26 are used to fasten the cover 22 to the shoulder strap 16 and hold it around the shoulder strap 16 as shown in FIG. 1. Attached to the ends 18 and 20 of the shoulder strap 16 are a pair of stirrup straps 28 and 30, which may be extensions of the shoulder strap 16. The stirrup straps 28 and 30 and the shoulder strap 16 may thus be one continuous piece of strap material of suitable strength to carry the weight of a pair of ski boots such as the boots 12 and 14. Each of the stirrup straps 28 and 30 has an inner end adjacent the respective end 18 or 20 of the shoulder strap.

Each of the opposite ends of a separate piece of strap material 32 about $1\frac{3}{4}$ inches long is sewn to the inner end of the stirrup strap 28, forming a passage 34 between the piece of strap material 32 and the stirrup strap 28. Another piece 32 is similarly sewn to the stirrup strap 30, forming a similar passage 35.

An ankle strap 36 extends across each stirrup strap 28 and 30 through the passage 34 defined by the pieces 32 of strap material. Each ankle strap 36 is equipped with a triple bar slide 38 forming an adjustable loop 40 in one of its ends, and a pair of wire loops, hereinafter called D-rings 42 and 43, are engaged pivotably in the loop 40. An opposite end 44 of the ankle strap 36 extends through both of the D-rings 42 and 43, around the D-ring 43, and back within the D-ring 42 in the well-known manner of fastening a strap using a pair of D-rings. This provides an easily adjustable and releasable manner of fastening each ankle strap 36 around the upper portion of the ski boot 12 or 14.

Each stirrup strap 28 and 30 has an outer end defining a loop 46 which is adjustably held by a triple bar slide 48 so that the loop 46 encompasses another portion of the ankle strap 36. The adjustability of the triple bar slide 38 and the triple bar slide 48 permits the boot carrier of the present invention to be used with ski boots of different heights and whose top portions are of different circumferences. By adjusting the length of the stirrup strap 28 or 30, the height at which the ski boot is carried in the boot carrier 10 may be adjusted, depending upon the size of the user and the height of the top portion of the boots 12 and 14, so that the ski boots 12 and 14 can be carried at the height which is most comfortable for the user.

Referring now to FIG. 2, it may be seen that the cover 22 is a quadrilateral sheet of flexible material such as oil tanned leather having rounded corners. Near two of the corners, along a side 50 of the cover 22, a pair of male snap fastener halves **24*b* and 26*b* extend through the shoulder strap 16 and the cover 22, fixedly attaching the cover 22 to the shoulder strap 16 with the side 50 extending along an edge of the shoulder strap 16. At the opposite corners of the cover 22, near the opposite side 52, are the mating female halves 24*a* and 26*a* of the snap fasteners 24 and 26. Thus the cover 22 may be rolled around the shoulder strap 16, and the fastener halves 26*a* and 26*b* may be fastened to the fastener halves 24*a* and 24*b*, respectively, holding the cover around the shoulder strap 16, as shown in FIG. 1, to provide padding between the shoulder strap 16 and a user's shoulder during use of the boot carrier 10**.

Referring now also to FIGS. 3 and 4, the boot carrier 10 may be folded into a compact package by sliding the outer end loop 46 of each of the stirrups 28 and 30 along the respective ankle strap 36 to lie alongside the inner end of the stirrup strap. The ankle straps 36 are both folded along a pair of fold axes 54 and 56, as shown in FIG. 3, to bring each of the ankle straps 36 alongside and parallel with the stirrup straps 28 and 30. The cover 22 is then closed by bringing the outer edge 52 around the edge 50, the stirrup straps 28 and 30, and the folded ankle straps 36, and the snap fasteners 24 and 26 are fastened to form a compact rollor sausage-shaped package, as shown in FIG. 4. The ski boot carrier 10 in this elongate, compact package, about 12 inches long and approximately 1½ inches in diameter, may be carried conveniently in a large pocket of a ski parka and is easily stored in a locker.

As shown in FIG. 5, instead of the D-rings 42 and 43, the ankle straps 36 may be provided with a keeper loop 60 held by the loop 40 held adjustably by the triple bar slide 38. Mating pieces 62 and 64 of hook-carrying and loop-carrying fastener material such as that marketed under the trademark Velcro may be fastened to the opposite end of the ankle strap 36 to permit easy opening and closure of the ankle strap 36.

A third alternative fastener for the ankle straps 36 is shown in FIG. 6. Mating portions 66 and 68 of a side release buckle set can be adjustably mounted on the opposite ends of the ankle straps 36 as shown. A buckle set of this type which would be satisfactory for this application is the 1-inch side release buckle, model SR1, manufactured by the Fastex Co. of Des Plains, Ill., and disclosed in U.S. Pat. No. 4,150,464.

As shown in FIG. 7, the cover 22 could also be attached to the shoulder strap 16 in other ways, such as by sewing, and other fasteners, such as mating pieces 72 and 74 of hook-and-loop fastener material, sewn or otherwise fastened to the cover 22, could be used in place of fasteners 24 and 26 to close the cover 22 around the shoulder strap 16.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A carrier for boots, comprising:

(a) a shoulder strap having a predetermined length and a pair of opposite ends;

(b) a pair of stirrup straps, a respective one of said pair being connected with each of said opposite ends of said shoulder strap;

(c) a pair of ankle straps, a respective one of said pair being attached to each of said stirrup straps; and (d) cover means fixedly attached to said shoulder strap, for enclosing said stirrup straps and ankle straps alongside said shoulder strap, in a folded configuration, said cover means including fastening means for selectively holding said cover means wrapped around said shoulder strap, stirrup straps and ankle straps.

2. The boot carrier of claim 1 including adjustable means for varying the effective length of each of said stirrup straps and each of said ankle straps.

3. The boot carrier of claim 1, wherein said stirrup straps are of textile fabric, each of said stirrup straps having an outer end and means located on said outer end thereof for forming an adjustable loop around a portion of the respective one of said pair of ankle straps.

4. The boot carrier of claim 1, each stirrup strap having an inner end and an outer end and including means attached thereto defining a passage for receiving a respective ankle strap and holding it attached to the respective stirrup strap at a location adjacent said inner end, and each stirrup strap also including means for forming a loop in said outer end.

5. The boot carrier of claim 4 wherein said means for forming a loop is adjustable so as to vary the distance between said passage and said loop.

6. The boot carrier of claim 1, including hook-and-loop fastener means located on at least one of said ankle straps for adjusting at least said one ankle strap to fit a boot.

7. The boot carrier of claim 1, said ankle straps each including a pair of ends and having adjustably positionable quick-release buckle means for fastening said ends of said ankle strap together to hold an upper portion of a boot.

8. The boot carrier of claim 1 wherein said ankle straps and stirrup straps are of flat fabric construction and are sufficiently flexible to be folded to lie alongside said shoulder strap.

9. The boot carrier of claim 1, wherein said cover means comprises a flexible sheet-like member and said fastening means comprises a pair of mating sets of snap fasteners, a first member of each set holding said flexible member fixedly attached to said strap, and a mating second portion of each set being located on an opposite portion of said flexible sheet-like member so as to fasten said cover means around said shoulder strap and around said stirrup straps and ankle straps in said folded configuration.

10. The boot carrier of claim 9 wherein said flexible sheet-like member is of leather.

11. The boot carrier of claim 9 wherein said flexible sheet-like member is of padded textile fabric.

12. The boot carrier of claim 1 wherein said shoulder strap and stirrups are a single piece of strap material.

13. The boot carrier of claim 1 wherein said cover means comprises a flexible sheet-like member and said fastening means comprises a mating set of pieces of hook-and-loop fastener material, fixedly attached to said flexible sheet-like member so as to fasten said cover means around said shoulder strap and around said stirrup straps and ankle straps in said folded configuration.

14. The boot carrier of claim 13 wherein said flexible sheet-like member is of leather.

15. The boot carrier of claim 13 wherein said flexible sheet-like member is of padded textile fabric.

16. The boot carrier of claim 1, each of said ankle straps having a pair of opposite ends and including a pair of D-rings attached to one of said opposite ends so as to receive and hold the other of said opposite ends adjustably, so as to adjust the length of each of said ankle straps to fit a respective one of a pair of boots.

* * * * *

UNITED STATES PATENT AND TRADEMARK OFFICE

CERTIFICATE OF CORRECTION

PATENT NO. : 4,867,359

DATED : September 19, 1989

INVENTOR(S) : Sharon J. Donovan

It is certified that error appears in the above-identified patent and that said Letters Patent is hereby corrected as shown below:

Col. 1, Line 58 Change "n" to --in--;

Col. 1, Line 65 Change "Nos." to --No.--.

Col. 5, Line 5 Change "rollor" to --roll- or--.

Signed and Sealed this

Sixth Day of August, 1991

*Attest:*

HARRY F. MANBECK, JR.

*Attesting Officer*

*Commissioner of Patents and Trademarks*